United States Patent [19]

Simon

[11] Patent Number: 4,461,581

[45] Date of Patent: Jul. 24, 1984

[54] LIGHT BEAM CLOCK

[76] Inventor: Jerome H. Simon, 17 Hubbard Ave., Cambridge, Mass. 02140

[21] Appl. No.: 326,847

[22] Filed: Dec. 3, 1981

Related U.S. Application Data

[63] Continuation of Ser. No. 146,345, May 5, 1980, Pat. No. 4,374,623.

[51] Int. Cl.[3] ..... G04B 19/00

[52] U.S. Cl. ..... 368/79

[58] Field of Search ..... 368/76, 77, 79, 82, 368/223, 228, 233; 362/26

[56] References Cited

U.S. PATENT DOCUMENTS

| | | | |
|---|---|---|---|
| 2,009,209 | 7/1935 | Scantlebury | 368/227 |
| 2,290,278 | 7/1942 | Failla | 362/26 |
| 2,534,877 | 12/1950 | Owen | 368/79 |
| 3,490,226 | 1/1970 | Anderson et al. | 362/26 |
| 3,651,634 | 3/1972 | Cooper | 368/79 |
| 4,034,549 | 7/1977 | Danley et al. | 368/79 |
| 4,253,170 | 2/1981 | Meisner | 368/79 |

*Primary Examiner*—Vit W. Miska

*Attorney, Agent, or Firm*—Joseph S. Iandiorio

[57] ABSTRACT

A light beam clock including a clock drive motor including a first member rotatable at the speed of one revolution per hour and a second member rotatable at the speed of one-twelfth revolution per hour; light source means; a circumferential portion; a beam mechanism including a first optical device mounted with the first member for directing light from the light source means in a first radial beam to form a first spot of light representing minutes on the circumferential portion, and a second optical device mounted with the second member for directing light from the light source means in a second radial beam to form a second spot of light for representing hours on the circumferential portion.

6 Claims, 11 Drawing Figures

LIGHT BEAM CLOCK

This application is a continuation of application Ser. No. 146,345, filed May 5, 1980 now U.S. Pat. No. 4,374,623.

FIELD OF INVENTION

This invention relates to a light beam clock which uses rotating radial beams of light to create spots to indicate time.

SUMMARY OF INVENTION

It is an object of this invention to provide a truly unique, appealing and attractive clock which uses light beams to indicate the time.

It is a further object of this invention to provide such a clock which is simple, inexpensive and compact.

It is a further object of this invention to provide such a clock which uses readily available optical and electrical components.

The invention features a light beam clock including a clock drive motor. The clock drive motor has a first member rotatable at the speed of one revolution per hour and a second member rotatable at the speed of one-twelfth revolution per hour. There is a light source and a housing including a circumferential portion. There is a beam mechanism including a first optical device mounted with the first member for directing light from the light source means in a first radial beam to form a first spot of light representing minutes on the circumferential portion, and a second optical device mounted with the second member for directing light from the light source means in a second radial beam to form a second spot of light representing hours on the circumferential portion.

In a preferred embodiment, the clock drive motor may include a third member rotatable at the speed of one revolution per minute, and the clock may further include a third optical device mounted with the third member for directing light from the light source means in a third radial beam to form a third spot of light representing seconds on the circumferential portion.

The light source means may include simply a single light source which illuminates each of the optical devices. The single light source may be mounted centrally of the clock and direct its radiation axially to the optical devices. The spot may be of quite limited area.

Alternatively, the light source means may include a light source remote from the clock axis and optical means for redirecting illumination from the light source axially to the optical device. Each optical device may include a mirror, and the mirror may be oriented to receive light axially and redirect it radially.

Or alternatively, each of the optical devices may include a lens for receiving the light axially and a light pipe for receiving the light from the lens and redirecting it radially. Also, alternatively, the optical device may include a cylindrical reflector with a gap to permit the escape of light: there may be a lens in the gap. The light source may include an elongate lamp, and the cylindrical reflectors may be arranged along it.

The light source means may include a plurality of separate light sources, one associated with each optical device, and the optical devices may include a reflector or a reflector with a lens at the open portion of the reflector.

The circumferential portion may include a translucent portion for displaying each spot of light as the radial beams rotate, or the circumferential portion may include a reflector surface for redirecting each spot of light to another surface. The circumferential portion may be separate from or fixed to one or more of the other parts of the light beam clock.

DISCLOSURE OF PREFERRED EMBODIMENT

Other embodiments will occur from the following description of a preferred embodiment and the accompanying drawings, in which.

The invention may be accomplished with a light beam clock that includes a clock drive motor including a first member rotatable at the speed of one revolution per hour and a second member rotatable at the speed of one-twelfth revolution per hour. Preferably there is a third member rotatable at the speed of one revolution per minute. There is also light source means and a circumferential portion. A beam mechanism includes a first optical device mounted with the first member for directing light from the light source means in a first radial beam to form a first spot of light of limited area representing minutes on the circumferential portion. A second optical device is mounted with the second member for directing light from the light source means in a second radial beam to form a second spot of light of limited area representing hours on the circumferential portion. Typically, a third optical device is mounted with the third member for directing light from the light source means in a third radial beam to form a third spot of light of limited area representing seconds on the circumferential portion. The circumferential portions may be translucent or transparent to display the light spots, or may be reflective to redirect the light spots to another area for display. The light spots may be of any desired shape, e.g. regular or irregular, geometric, images, silhouette. The circumferential portion may be fixed to the other parts of the clock or separate from them, as for example if the circumferential portion is built into a wall on which the clock is hung. The optical devices or the light source may include means to provide each beam with a different color. The light sources may be powered with a transformer to drop the normal line voltage from 110 volts to a safer level. Alternatively, the light source and motor may be driven by battery. The power source may be provided with a switch to provide more than one level of intensity of illumination, for example dim and bright.

The light source means may include a single light source, which illuminates all of the optical devices, or separate light sources associated with each of the optical devices. The light source may be located at the clock and direct its radiation axially to the optical devices, or the light source means may include a light source remote from the clock and some means at the clock to redirect the light from the remote light source axially to the optical devices. The optical devices themselves may include mirrors of various shapes: elliptical, cylindrical, flat; and may also include lenses and filters as necessary or desirable.

Figure 1:
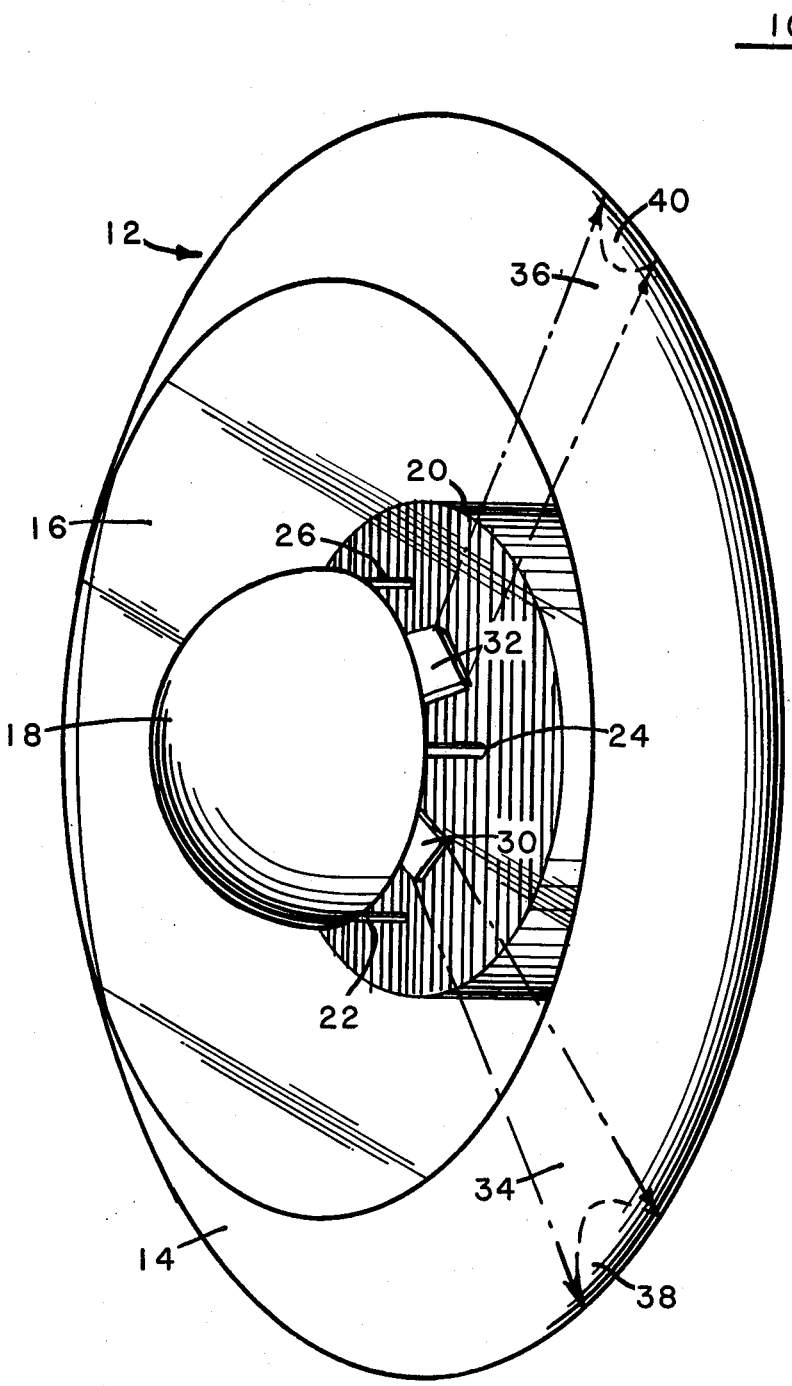
FIG. 1 is an axonometric view of a light beam clock according to this invention.

There is shown in FIG. 1 a light beam clock 10 according to this invention, including a housing 12 which includes translucent circumferential portion 14, transparent face 16, and opaque cover 18 and base 20. Cover 18 contains a light source and is mounted to base 20 by means or rods 22, 24, 26. A portion of beam mechanism 28 is shown including optical devices, mirrors 30 and 32, which produce hour beam 34 and minute beam 36 which terminate at circumferential portion 14 in light spots 38, 40.

Figure 2:
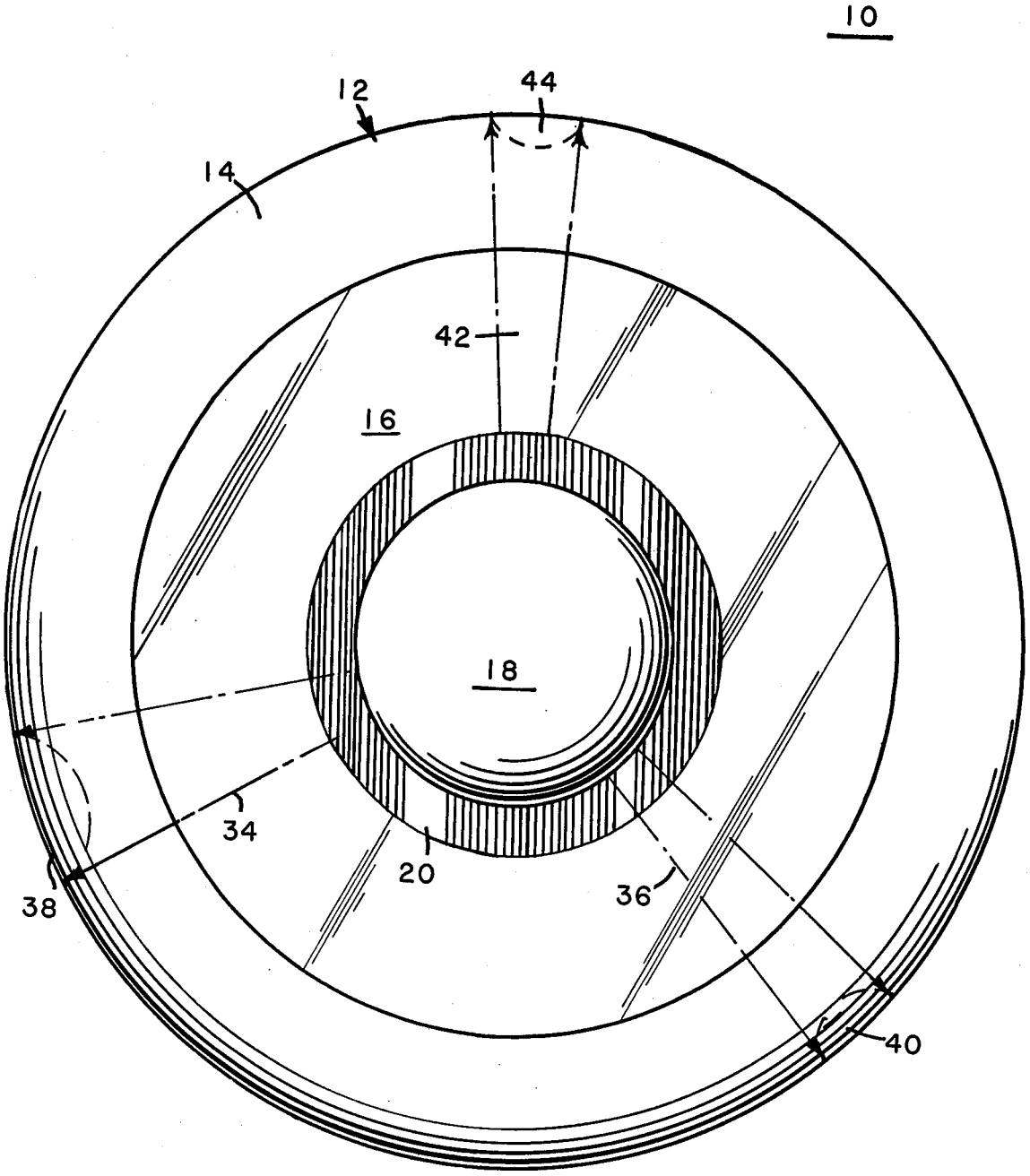
FIG. 2 is a front view of the clock of FIG. 1.
Figure 3:
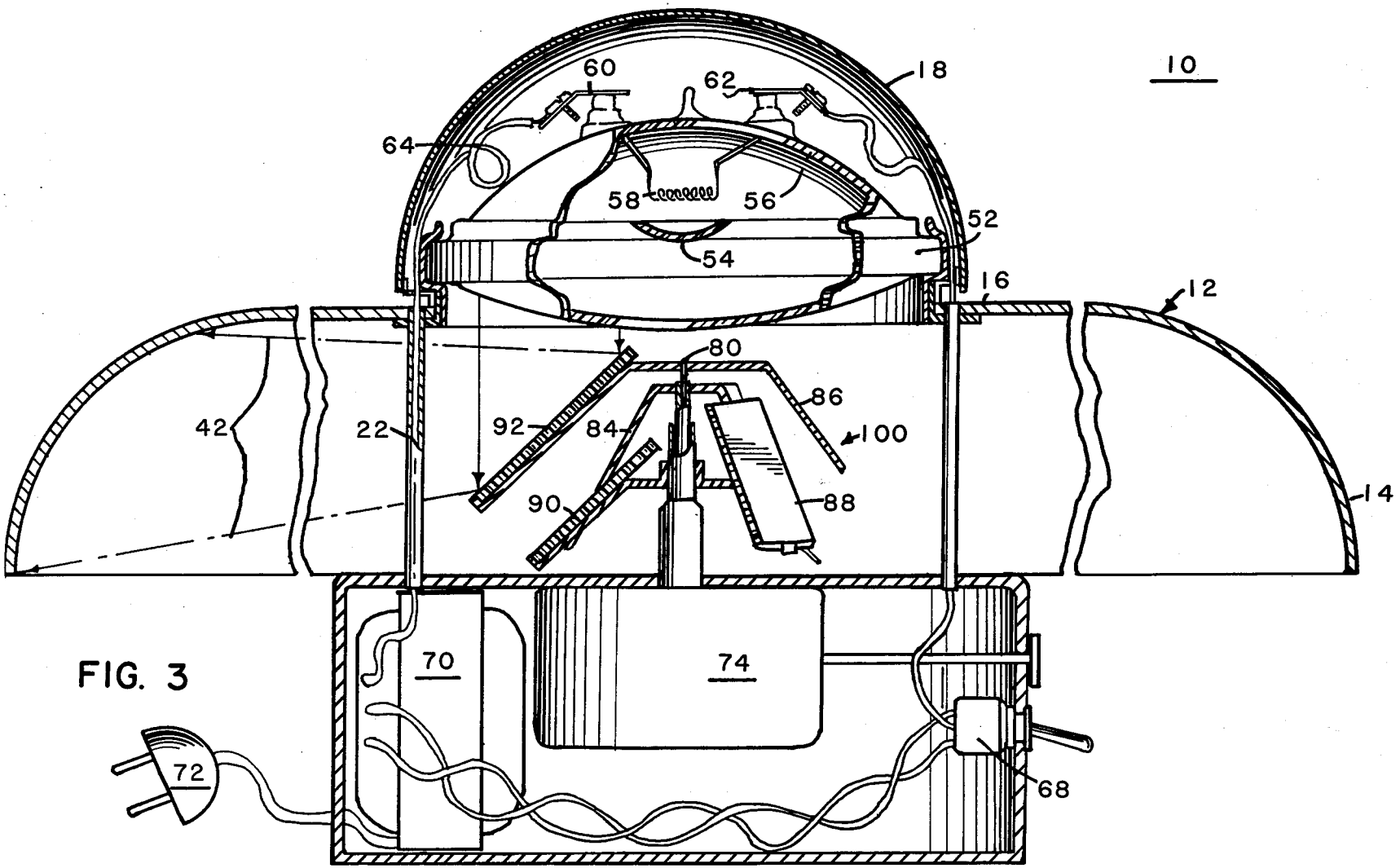
FIG. 3 is a side elevational view in section of the clock of FIG. 1.

Clock 10 is shown in FIG. 2 with the hour beam 34 and minute beam 36 is slightly different positions, and an additional beam 42 which terminates at spot 44 and indicates seconds. Hour beam 34 has a width of approximately 30°, while minute beam 36 and second beam 42 have a width of approximately 6°. Light source means 50, FIG. 3, disposed in cover 18, includes an envelope 52 which includes a mirror 54, which in combination with reflector surface 56 concentrates the light from filament 58. Filament 58 is powered through terminals 60, 62 that are energized, respectively, through wires 64 and 66. Wire 66 is connected through two-position switch 68 to transformer 70. Wire 64 is directly connected to transformer 70, and transformer 70 is connected to normal 110-volt AC power by means of plug 72. In one position, switch 68 provides the highest power to filament 58. In the dim position it provides somewhat less power to light source means 50. Light source means 50, as illustrated in FIG. 3, may be constituted by a simple seal-beam headlight. Clock drive motor 74 is mounted in base 20 with its multiple shafts 76, 78, and 80 extending upwardly through the base and supporting mounting members 82, 84, and 86, which in turn carry the first optical device, mirror 88, which produces the minute beam, the second optical device, mirror 90, which produces the hour beam, and the third optical device, mirror 92, which produces the second beam. The simple beam mechanism 100 constituted by mirrors 88, 90, and 92 creates the radial beams that indicate the minutes, hours and seconds.

Figure 4:
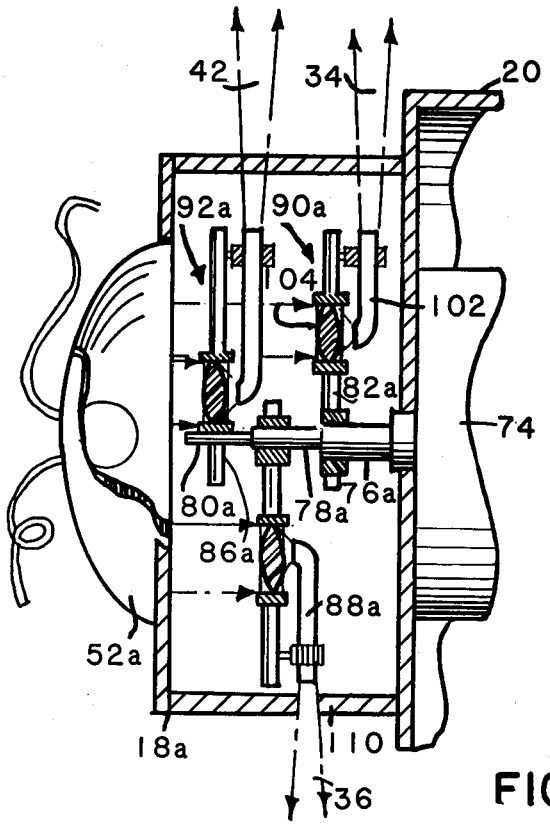
FIG. 4 is a side elevational section view of an alternative beam mechanism which may be used in a clock according to this invention.

Alternatively, as shown in FIG. 4, the position of the motor and the light source means may be interchanged, and the optical devices 90*a*, 88*a*, and 92*a* may each include a light pipe 102 and lens 104 mounted to their respective members 82*a*, 84*a*, and 86*a* fixed to shafts 76*a*, 78*a*, and 80*a*. In FIG. 4, light source means 50*a* is mounted above cover 18*a*, and cover 18*a* is transparent as in area 110 to permit emission of the hour, minute and second beams 34, 36, and 42, respectively.

Figure 5:
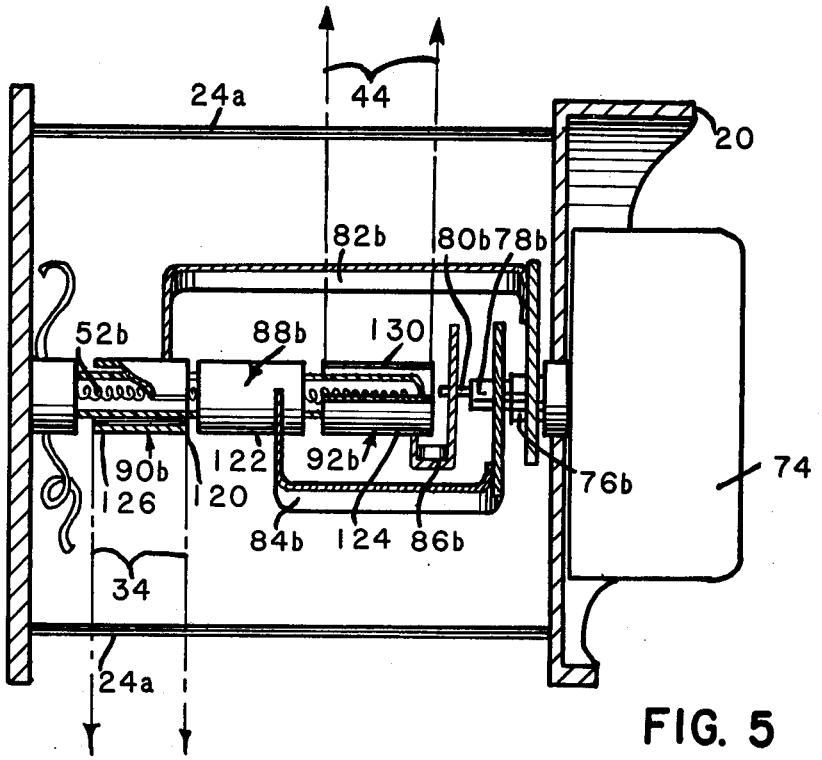
FIG. 5 is a side elevational section view of another alternative beam mechanism which may be used in a clock according to this invention.

Although thus far light source 52*a* is illustrated located external to the optical devices, this is not a necessary limitation of the invention. For example, as shown in FIG. 5, light source 52*a* is a long filament lamp which is surrounded by optical devices 90*b*, 88*b*, and 92*b* which include cylindrical reflectors 120, 122, 124, having gaps 126, 128, now shown, and 130, through which the light from lamp 52*b* escapes. These cylindrical reflectors 120, 122, and 124 are mounted on members 82*b*, 84*b*, and 86*b*, which are driven by shafts 76*b*, 78*b*, and 80*b*. Reflector 120 provides hour beam 34, reflector 122 provides minute beam 36, not visible, and reflector 124 provides second beam 44.

Figure 6:
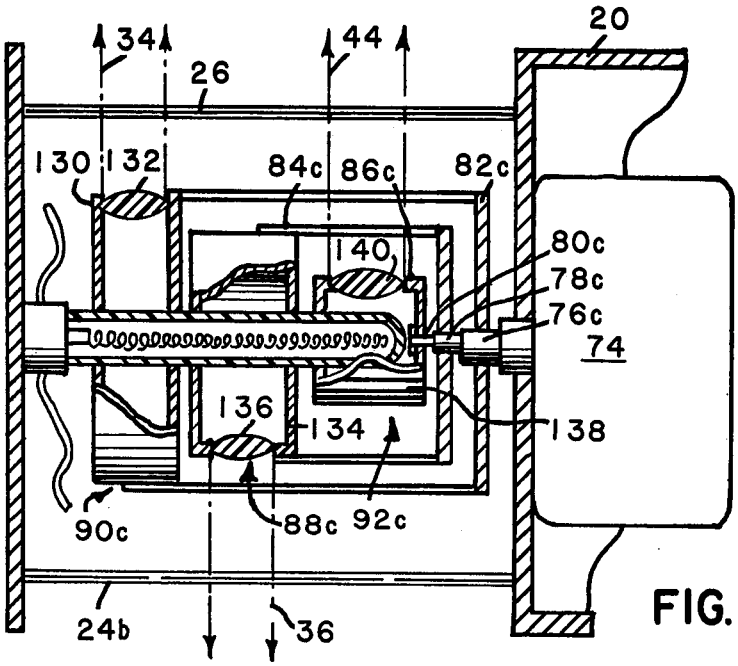
FIG. 6 is a side elevational view of still another alternative beam mechanism which may be used in a clock according to this invention.

Slightly different optical devices 90*c*, 88*c*, and 92*c* are shown in FIG. 6, in which optical device 90*c* includes a cylinder 130 with a lens 132 provided in its gap or opening to produce hour beam 34. Optical device 88*c* includes a slightly smaller cylindrical reflector 134 which includes lens 136 in its gap to produce minute beam 36; and optical device 92*c* includes an even smaller cylindrical reflector 138 which uses lens 140 in its gap to produce second beam 44. Reflectors 130, 134 and 138 are mounted in the usual fashion by their respective members to the hour, minute and second hands.

Figure 7:
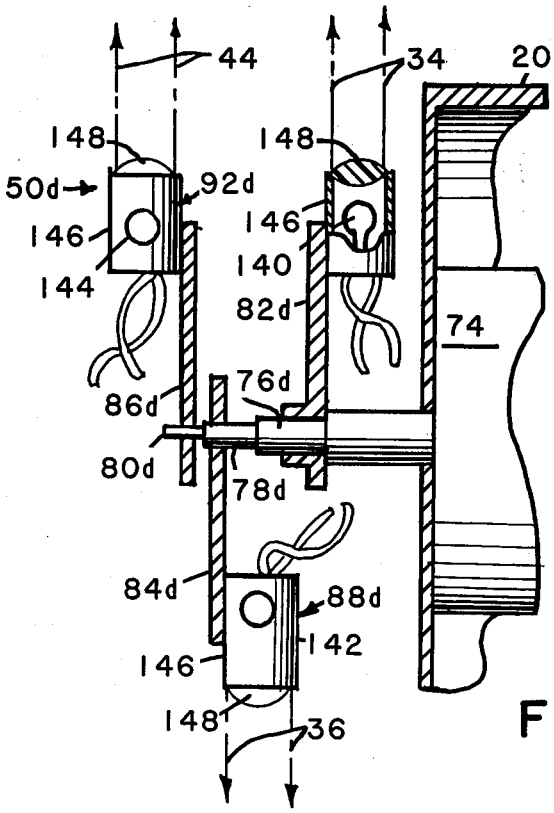
FIG. 7 is a side elevational section view of yet another alternative beam mechanism which may be used in a clock according to this invention.

Although thus far the light source means 50 has been shown as a single light source, this is not a necessary limitation of the invention. For example, as shown in FIG. 7, light source means 50*d* includes three light sources, lamps 140, 142 and 144, which are included in optical devices that create the hour beam 34, minute beam 36, and second beam 44.

Figure 8:
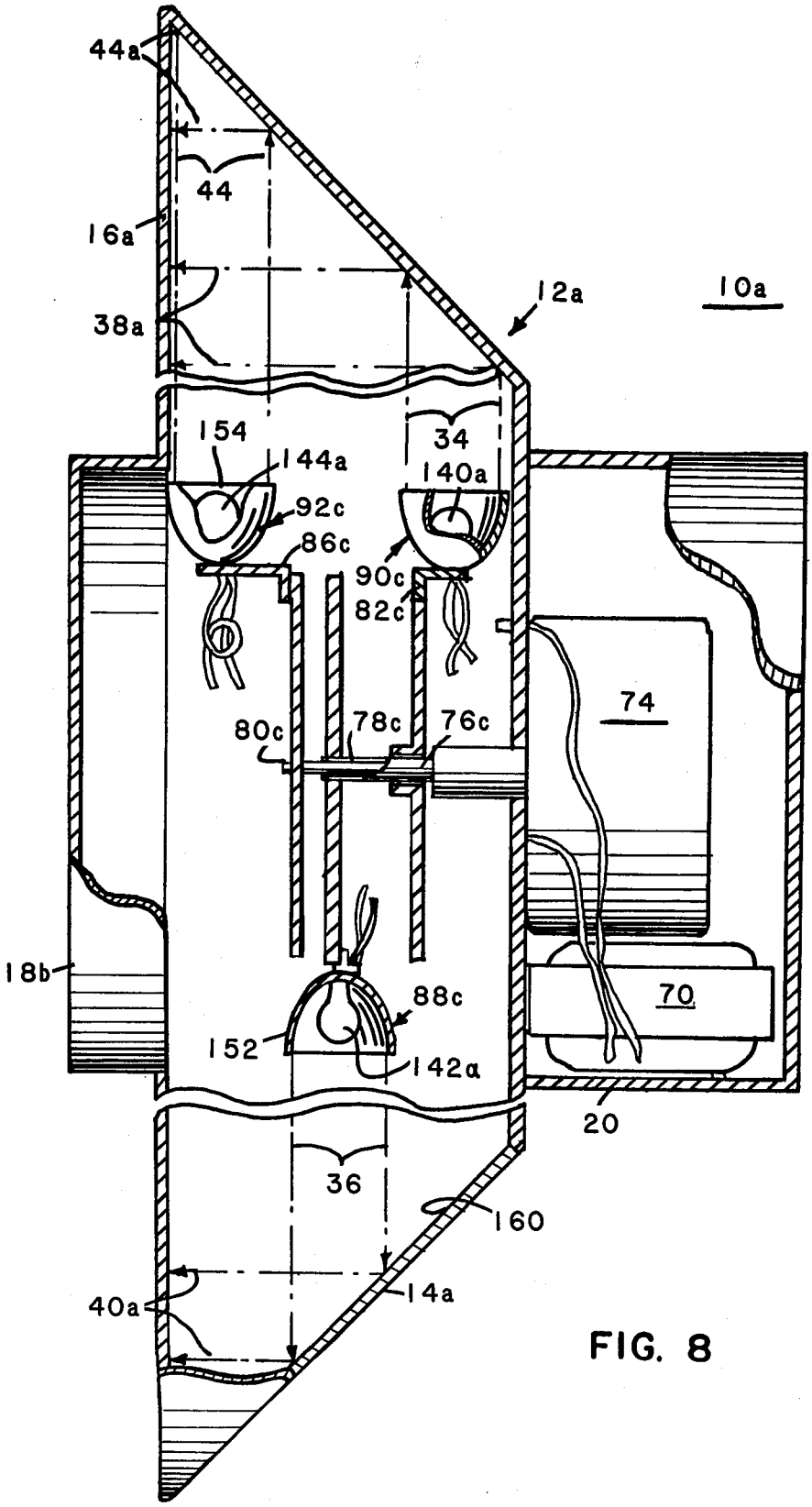
FIG. 8 is a side elevational section view of a clock according to this invention employing an alternative circumferential portion and beam mechanism.

Optical device 90*e*, 88*e*, and 92*e* include elliptical reflectors 150, 152, and 154, FIG. 8, and direct their beams 34, 36, and 44 to reflective surfaces 150, 160, on the inside of circumferential portion 14*a*, which redirects the beams to form spots 38*a*, 40*a*, and 44*a* on face 16*a* of housing 12*a*. Lamps 140*a*, 142*a*, 144*a* are powered through wire leads connected to slip rings and the like.

Figure 9:
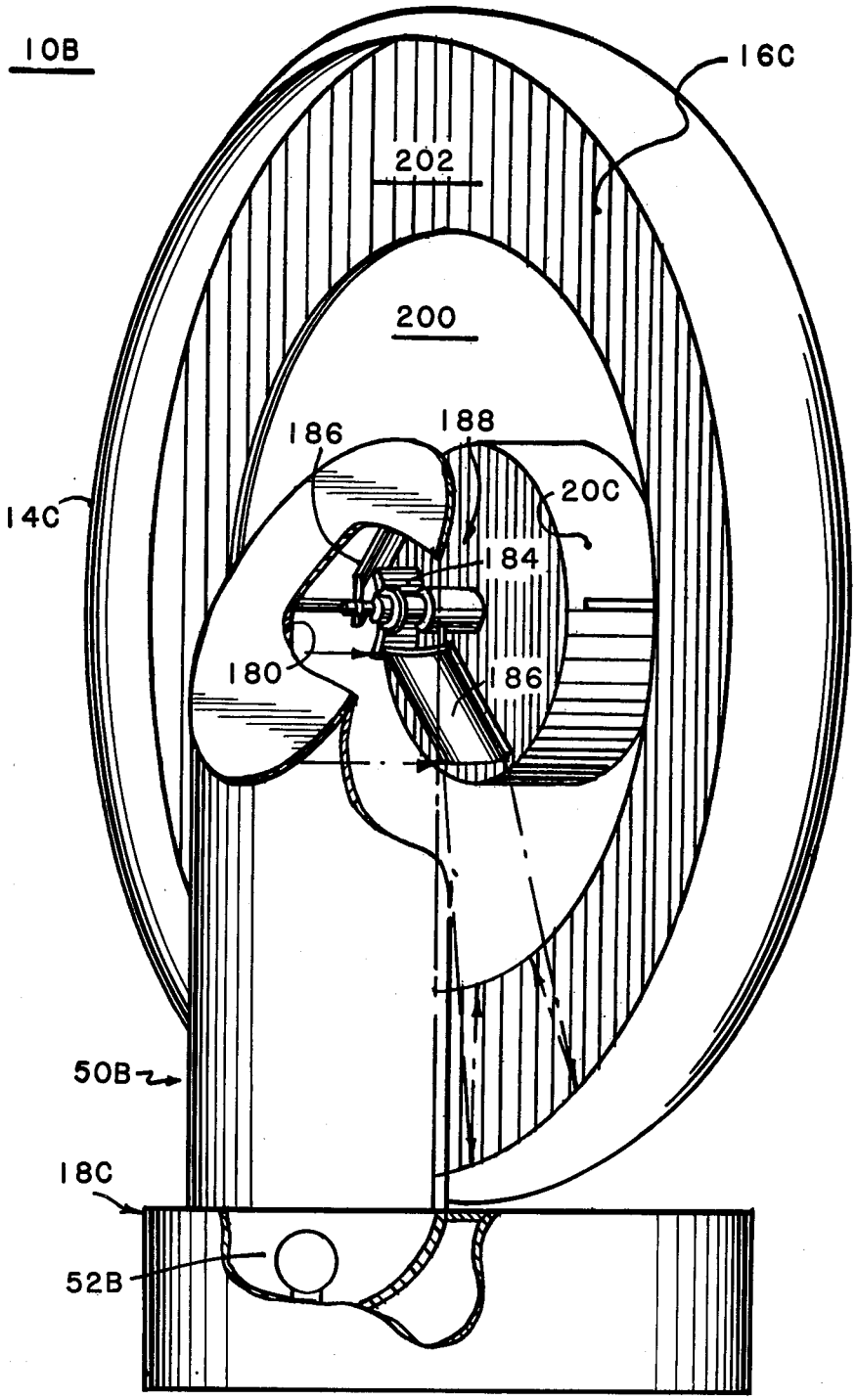
FIG. 9 is an axonometric view of a clock with a remote light source according to this invention.

Although thus far the invention has been disclosed with light source means at the clock with the light aimed directly down the axis of the clock motor, this is not a necessary limitation of the invention, for as shown in FIG. 9, clock 10*c* may include a light source means 50*b* that has a light source 52*b* in a base 18*c*, and a reflecting surface 180 on the inside of cover 18*c* to redirect the light from light source 52*b* axially inward to strike mirrors 182, 184, and 186 in beam mechanism 188.

Figure 10:
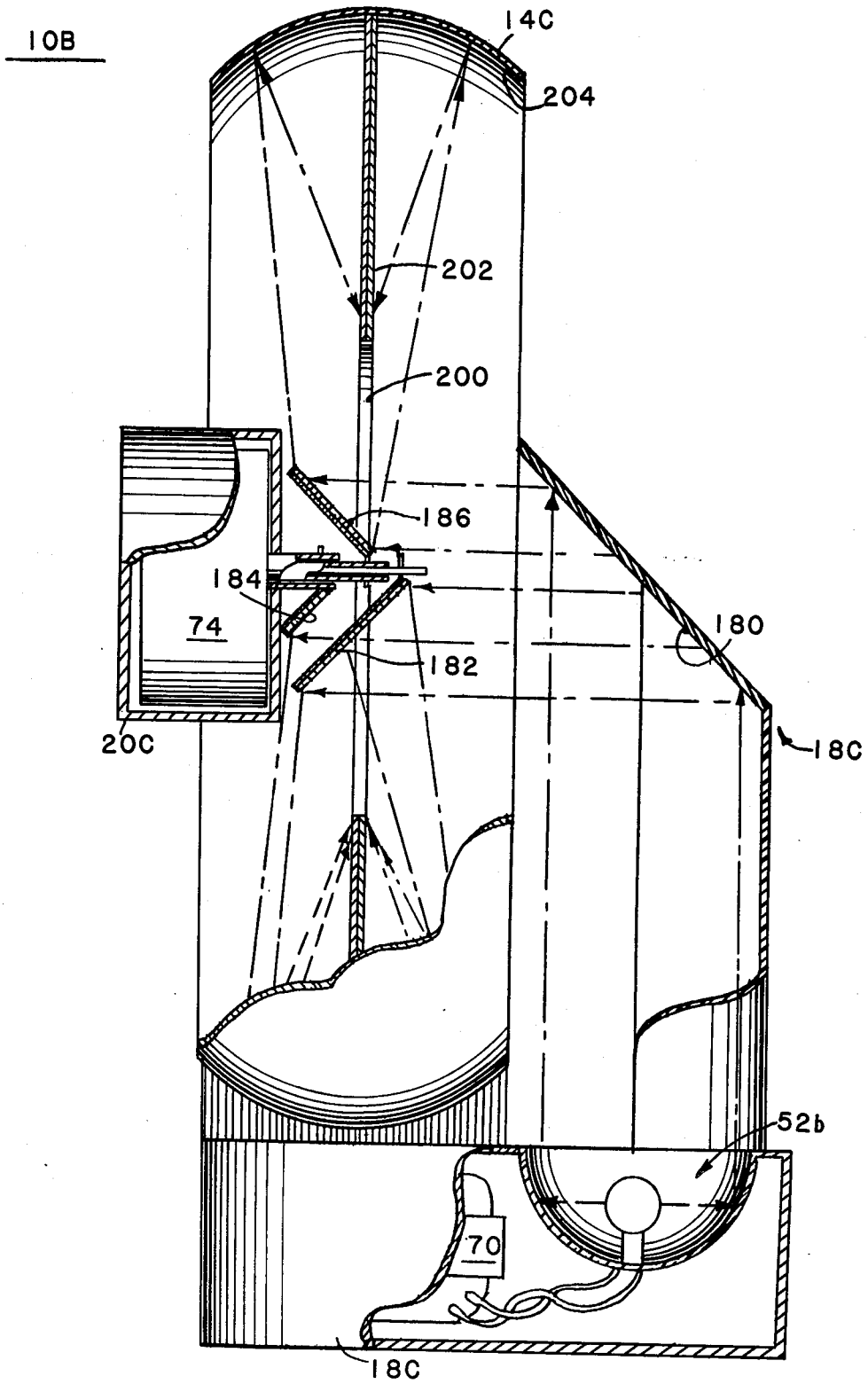
FIG. 10 is a side elevational view of the clock of FIG. 9.
Figure 11:
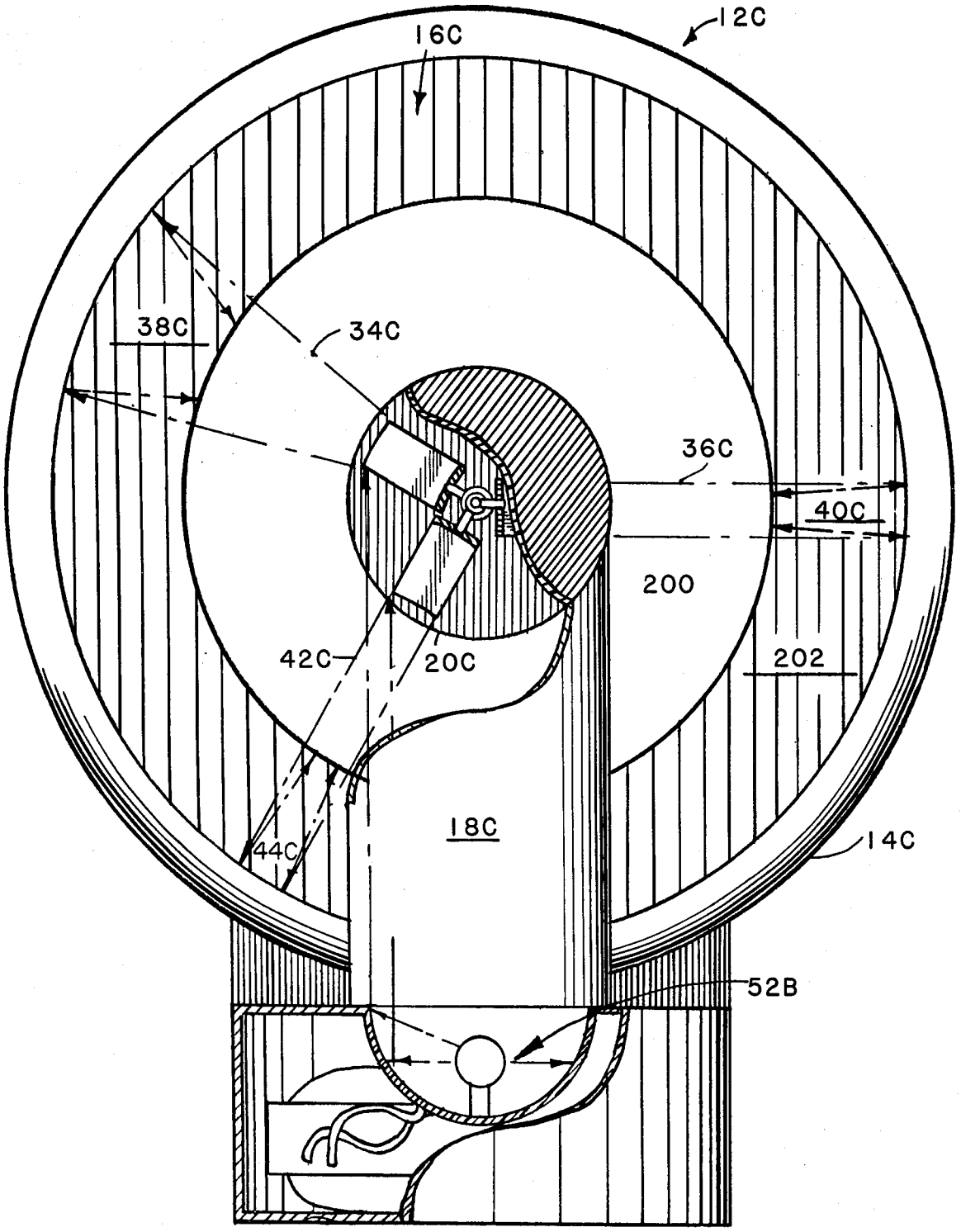
FIG. 11 is a front view with portions broken away of the clock of FIG. 9.

In clock 10*c*, face 16*c* includes two portions: a clear portion 200 and translucent or opaque portion 202. Circumferential portion 14*c* includes inner reflective surface 204, FIG. 10, where there are formed trapezoidal-shaped spots 38*c*, 40*c*, and 44*c*, FIG. 11, by beams 34*c*, 36*c*, and 42*c*, from which the hour, minute and second indications are derived.

Although throughout the specification for ease of presentation the circumferential portion 14 has been shown attached to cover 18 and base 20, such as by face 16, this is not a necessary limitation of the invention. The portion 14 may be built in part of a wall on which the base and cover portions are mounted and no force 16 is required.

Other embodiments will occur to those skilled in the art and are within the following claims:

What is claimed is:

1. A light beam clock comprising:

a clock drive motor including a first member rotatable about the clock axis at the speed of one-twelfth revolution per hour;

light source means for providing a beam of light and directing said beam of light axially, centrally toward said members;

a circumferential portion;

a beam memchanism including a first optical device which includes a mirror mounted with said first member in said beam of light for receiving said axial beam of light from the light source means and redirecting it in a first radial beam to form a first spot of light representing minutes on said circumferential portion and a second optical device which includes a mirror mounted with said second member in said beam of light for receiving said axial beam of light from said light source means and redirecting it in a second radial beam to form a second spot of light representing hours on said circumferential portion.

2. The light clock of claim 1 in which said clock drive motor includes a third member rotatable at the speed of one revolution per minute and said clock further includes a third optical device mounted with said third member in said beam of light for receiving said axial beam of light from said light source means and redirecting it in a third radial beam to form a third spot of light representing seconds on said circumferential display portion.

3. The light beam clock of claim 1 in which said light source means includes a single light source whose beam illuminates all of said optical devices.

4. The light clock of claim 1 in which said light source means is mounted centrally relative to said clock axis.

5. The light clock of claim 1 in which said light source means includes a light source remote from the clock axis and optical means for redirecting illumination from said light source means axially to said optical devices.

6. A light beam clock comprising:

a clock drive motor including a first member rotatable about the clock axis at the speed of one revolution per hour and a second member rotatable about the clock axis at the speed of one-twelfth revolution per hour;

light source means for providing a beam of light and directing said beam of light axially, centrally toward said members;

a circumferential portion;

a beam mechanism including a first mirror mounted with said first member in said beam of light for receiving said axial beam of light from the light source means and redirecting it in a first radial beam to form a first spot of light representing minutes on said circumferential portion and a second mirror mounted with said second member in said beam of light for receiving said axial beam of light from said light source means and redirecting it in a second radial beam to form a second spot of light representing hours on said circumferential portion.

* * * * *

UNITED STATES PATENT AND TRADEMARK OFFICE

CERTIFICATE OF CORRECTION

PATENT NO. : 4,461,581

DATED : July 24, 1984

INVENTOR(S) : Jerome H. Simon

It is certified that error appears in the above-identified patent and that said Letters Patent is hereby corrected as shown below:

The title page should appear as per attached sheet.

Signed and Sealed this

*Nineteenth* Day of *February 1985*

[SEAL]

*Attest:*

DONALD J. QUIGG

*Attesting Officer*

*Acting Commissioner of Patents and Trademarks*

United States Patent [19]

Simon

[11] Patent Number: 4,461,581

[45] Date of Patent: Jul. 24, 1984

[54] LIGHT BEAM CLOCK

[76] Inventor: Jerome H. Simon, 17 Hubbard Ave., Cambridge, Mass. 02140

[21] Appl. No.: 326,847

[22] Filed: Dec. 3, 1981

Related U.S. Application Data

[63] Continuation of Ser. No. 146,345, May 5, 1980, Pat. No. 4,374,623.

[51] Int. Cl.[3] ..... G04B 19/00

[52] U.S. Cl. ..... 368/79

[58] Field of Search ..... 368/76, 77, 79, 82, 368/223, 228, 233; 362/26

[56] References Cited

U.S. PATENT DOCUMENTS

| | | | |
|---|---|---|---|
| 2,009,209 | 7/1935 | Scantlebury | 368/227 |
| 2,290,278 | 7/1942 | Failla | 362/26 |
| 2,534,877 | 12/1950 | Owen | 368/79 |
| 3,490,226 | 1/1970 | Anderson et al. | 362/26 |
| 3,651,634 | 3/1972 | Cooper | 368/79 |
| 4,034,549 | 7/1977 | Danley et al. | 368/79 |
| 4,253,170 | 2/1981 | Meisner | 368/79 |

*Primary Examiner*—Vit W. Miska

*Attorney, Agent, or Firm*—Joseph S. Iandiorio

[57] ABSTRACT

A light beam clock including a clock drive motor including a first member rotatable at the speed of one revolution per hour and a second member rotatable at the speed of one-twelfth revolution per hour; light source means; a circumferential portion; a beam mechanism including a first optical device mounted with the first member for directing light from the light source means in a first radial beam to form a first spot of light representing minutes on the circumferential portion, and a second optical device mounted with the second member for directing light from the light source means in a second radial beam to form a second spot of light for representing hours on the circumferential portion.

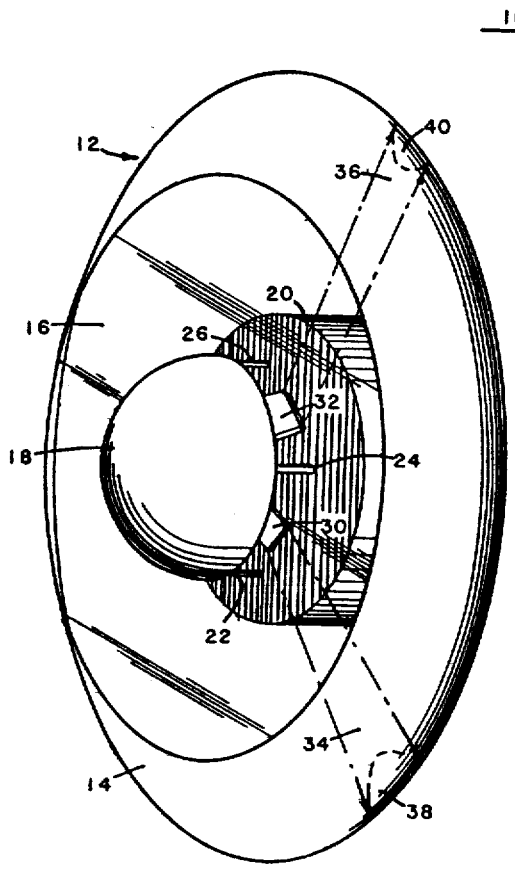

6 Claims, 11 Drawing Figures